United States Patent [19]

Ulrich

[11] Patent Number: 5,061,020

[45] Date of Patent: Oct. 29, 1991

[54] DISHWASHER RACK CHANNEL CAP

[75] Inventor: David J. Ulrich, Brookville, Ind.

[73] Assignee: White Consolidated Industries, Inc., Cleveland, Ohio

[21] Appl. No.: 559,259

[22] Filed: Jul. 30, 1990

[51] Int. Cl.[5] ..... A47B 77/06

[52] U.S. Cl. ..... 312/228; 312/348

[58] Field of Search ..... 312/228, 348, 341.1

[56] References Cited

U.S. PATENT DOCUMENTS

| | | | |
|---|---|---|---|
| 1,207,786 | 12/1916 | Olree | 312/348 |
| 2,811,407 | 10/1957 | Moore et al. | 312/348 X |
| 3,982,802 | 9/1976 | Bailey . | |
| 4,097,098 | 6/1978 | Fields . | |
| 4,437,715 | 3/1984 | Jenkins . | |
| 4,469,084 | 9/1984 | Fler et al. | 312/348 X |

*Primary Examiner*—Joseph Falk

*Attorney, Agent, or Firm*—Pearne, Gordon, McCoy & Granger

[57] ABSTRACT

A front opening household dishwasher has an upper rack having wheels that roll inside a C-shaped support channel, which in turn is mounted on support rollers attached to the inside of the tub. Each end of the channel is closed off by end caps to prevent the rack wheels from escaping from the channel, and to limit sliding movement of the channel with respect to the support rollers. Each end cap is a unitary structure having a body portion abutting the end of the channel and extending above and below the upper and lower edges of the channel. An arm portion is integral with the body portion and is connected thereto by a hinge portion at one side, and the arm extends through a pair of aligned openings at the upper and lower walls of the channel to engage a flexible detent hook on the other side of the channel to allow the end cap to be easily assembled and disassembled from the channel.

16 Claims, 4 Drawing Sheets

DISHWASHER RACK CHANNEL CAP

BACKGROUND OF THE INVENTION

This invention relates generally to dishwashers of the household undercounter type, and more particularly to the supporting structure for a sliding rack of the upper rack type mounted on the side wall of the dishwasher tub.

The typical dishwasher of this type has a downwardly opening hinged door which pivots through 90 degrees to a horizontal position. The dishes and other items being washed are carried on two wire racks specially configured to hold the items, with pans and large plates usually on the bottom or lower rack and glasses, cups and similar pieces usually placed on an upper rack. The lower rack is usually provided with wheels which roll along rails or ledges formed on the tub walls in alignment with the inner surface of the door in the open position. This allows the lower rack to be rolled on the wheels out onto the inner face of the open door for easy loading and unloading.

The upper rack presents more of a mounting problem because it must be mounted on the side walls of the tub. Since the upper rack is close to the top of the tub, it must be movable almost all of the way out of the tub for loading and unloading, and this requires that the rack be movably supported on an intermediate channel or rail, which in turn is movably supported on the tub wall. A well-known arrangement for supporting the upper rack is the use of a generally C-shaped channel or rail having the open side facing the interior of the tub. The channel is positioned and journaled for horizontal movement by at least two pairs of vertically spaced support rollers on the side wall of the tub near the front and middle portions of the tub. The rollers are grooved to receive the rounded upper and lower edges of the channel to allow it to slide freely in a horizontal direction parallel to the tub wall, but restrain the channel against any vertical movement or any transverse movement away from the tub wall. The upper rack has on each side at least two projecting rollers which fit within the channel with a minimum vertical clearance to positively position the rack with respect to the channel, yet allow the rack to slide freely along the channel. Thus, the upper rack can roll along the channel as the channel rolls along the supporting rollers on the tub so that the rack can slide far enough with the channel to move completely out of the tub, with the channel moving about half of the total movement of the rack.

While the foregoing arrangement has been widely used, it has been recognized that one of the problems has been the provision of a stop at each end of the channel to prevent the rollers on the rack from escaping from the channel. Since the channel is generally formed with open ends from relatively thin sheet metal such as a stainless steel, it is recognized that it is necessary to place a stop member at each end of the channel to retain the rack rollers and prevent the channel from moving out of the support rollers. To allow the upper rack to be easily removable for cleaning or repair, the stop member should be easily removable as well as easily replaceable without the use of any special tools, while being of sufficiently low cost of manufacture.

Another function of the stop member is to provide a resilient bumper for the rack rollers when they reach the end of the channel so that they do not make a noisy impact with the stop member or produce a sharp impact which might cause fragile items on the rack to be broken.

One arrangement which has been used is a stop member or bumper formed of a relatively soft rubber which fits within the channel and is held in place by an elongated pin extending vertically through the top and bottom walls of the channel and through the body of the bumper, as shown in U.S. Pat. No. 4,097,098. This arrangement is relatively expensive and requires the use of two pieces, with the risk that the pin can be easily lost by the user during removal and replacement of the bumper during ordinary use. Other arrangements include the use of relatively complex snap-in plastic pieces such as those shown in U.S. Pat. Nos. 3,982,802 and 4,437,715. However, these arrangements require careful manipulation during removal and replacement and are subject to possible over-stressing and breakage, resulting in failure of the part.

SUMMARY OF THE INVENTION

In accordance with the preferred embodiment of the present invention, an undercounter dishwasher has an upper rack support on each side of the tub in the form of a generally C-shaped channel member which is mounted for horizontal axial reciprocatory movement by two pairs of vertically spaced rollers secured on the side walls of the tub which engage and support the channel along the top and bottom wall portions of the channel. The rack itself has a pair of horizontally aligned rollers on each side which fit within the channel to contact the inner sides of the top and bottom wall portions of the channel, to guide the rack with respect to the channel, so that as the upper rack slides out of the tub, not only does the rack roll along the channel, but the channel rolls along the supporting rollers. Thus, when the upper rack is moved the full distance out of the tub, the channel is moved about one-half of the distance.

To limit movement of the rack with respect to the channel, the channel is provided with stop members at each end to limit the rolling or sliding motion of the rack rollers. According to the present invention, these stop members are in the form of a one-piece member having a body forming a vertical end wall extending across the end of the channel and both above and below the upper and lower wall portions of the channel. The stop member has projections extending from the top and bottom portions of this end wall over the top and bottom outer surfaces of the channel. The channel is formed with aligned openings in the top and bottom walls of the channel a spaced distance from the end, and one of the stop member projections has an arm portion integral at one end with the stop member extending vertically through both of the openings in the channel walls. The free end of the arm portion extending through the opening opposite the integral end has a tip which makes a snap fit with a recess on the other stop member projection to hold the stop member in a fixed position in the end of the channel. The side of the arm facing the rack rollers is formed with upper and lower sloping surfaces which engage the surface of the roller to provide a snubbing action and minimize impact when the roller reaches the end of the channel. In addition, the projections extending from the top and bottom of the end wall form another set of bumpers to act as a stop by engaging the channel support rollers whenever the channel reaches either end of its travel with respect to the tub.

With this arrangement, the novel stop member of this invention provides a one-piece stop member and bumper for the end of the rack supporting channel which is easily assembled in place on the channel and which is also easily removed and subsequently replaced to allow the rollers on the rack to be moved out of the channel so that the rack, and subsequently the channel, can be removed from the interior of the dishwasher tub for cleaning or repair.

DETAILED DESCRIPTION OF THE PREFERRED EMBODIMENT

Figure 1:
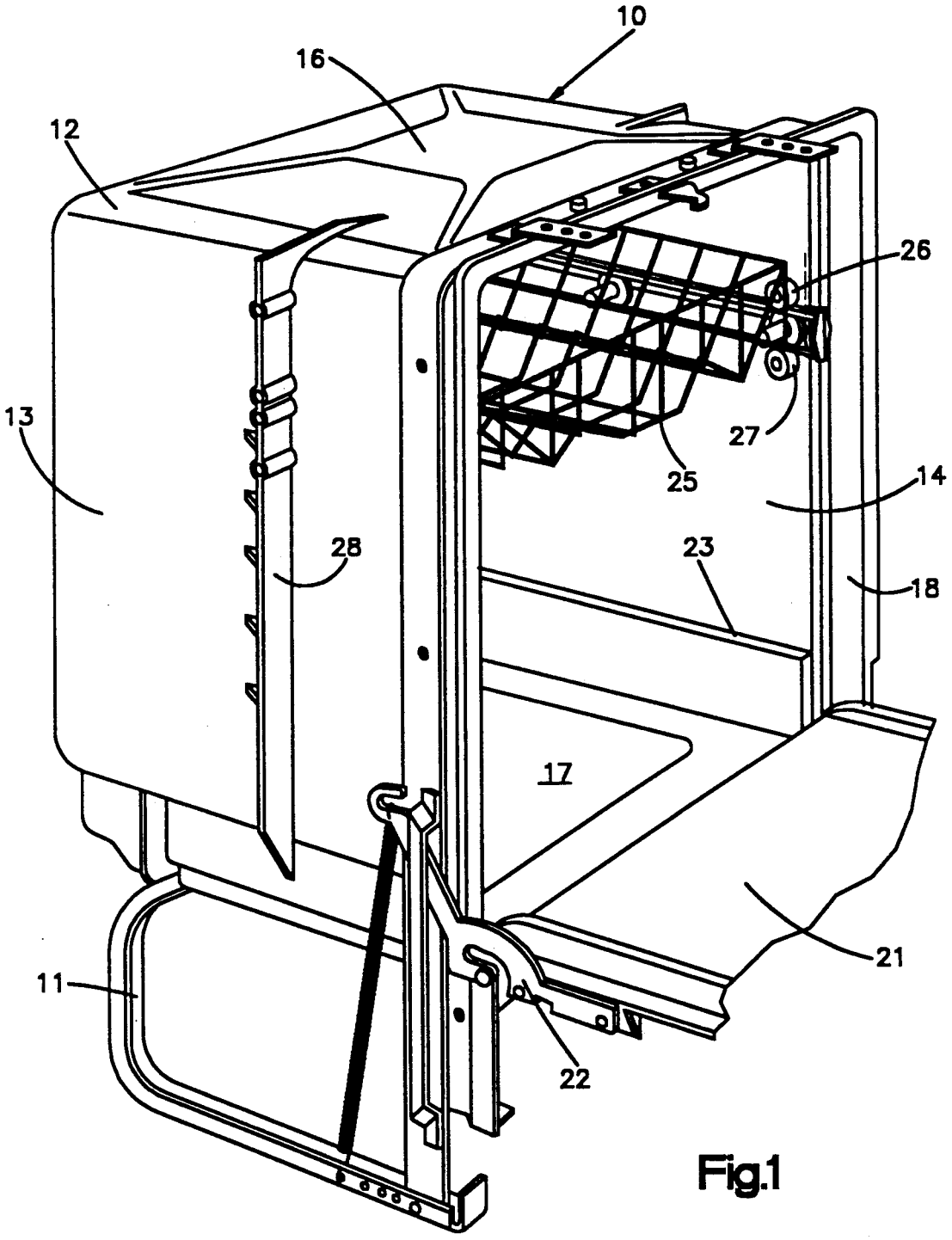
FIG. 1 is a perspective view of an undercounter dishwasher, showing the mounting of the upper rack.

Referring to the drawings in greater detail, FIG. 1 shows a dishwasher 10 of the undercounter type prior to installation, with the door open and the lower rack removed. The dishwasher includes a generally cubical tub 12 which is supported on a bottom frame 11 a spaced distance above the floor to allow space for the various valves, motor, and pump to be located beneath the tub. The tub 12 includes left and right side walls 13 and 14, together with a top wall 16 and bottom wall 17, which, together with a back wall (not shown), define a completely enclosed space except for the front, where the walls define an open edge 18 closed off by a suitable door 21, which is mounted on hinges 22 to open along a horizontal axis the bottom of the front of the tub. As shown, the tub side walls may include a rail portion 23 on each side to provide support for the bottom rack (not shown). It will be understood that the foregoing structure is shown and described as background only, to describe a typical dishwasher with which the present invention can be used.

The upper rack 25 is mounted horizontally a spaced distance below the top wall 16, and to provide this mounting, top and bottom front support rollers 26 and 27 are rotatably journaled on suitable mounting means attached to the right side wall 14. It will be understood that rollers are mounted on each side, and generally comprise two pairs of top and bottom support rollers, one pair at the front, in the position of rollers 26 and 27, and a second pair being located midway back along the point shown by reinforcing rib 28 on the outer surface of left side wall 13, it being understood that a similar reinforcing rib is on the outside of the right side wall 14.

Figure 8:
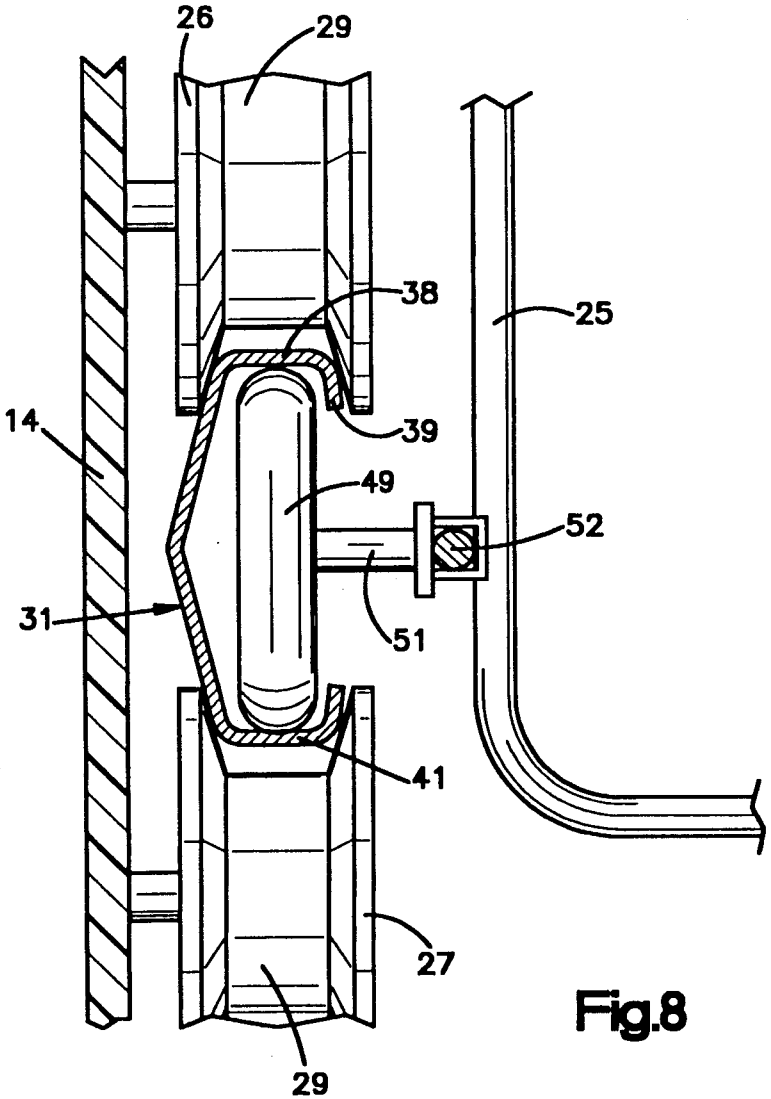
FIG. 8 is an enlarged, fragmentary, vertical view, partially in section, showing details of the mounting of the upper rack.
Figure 7:
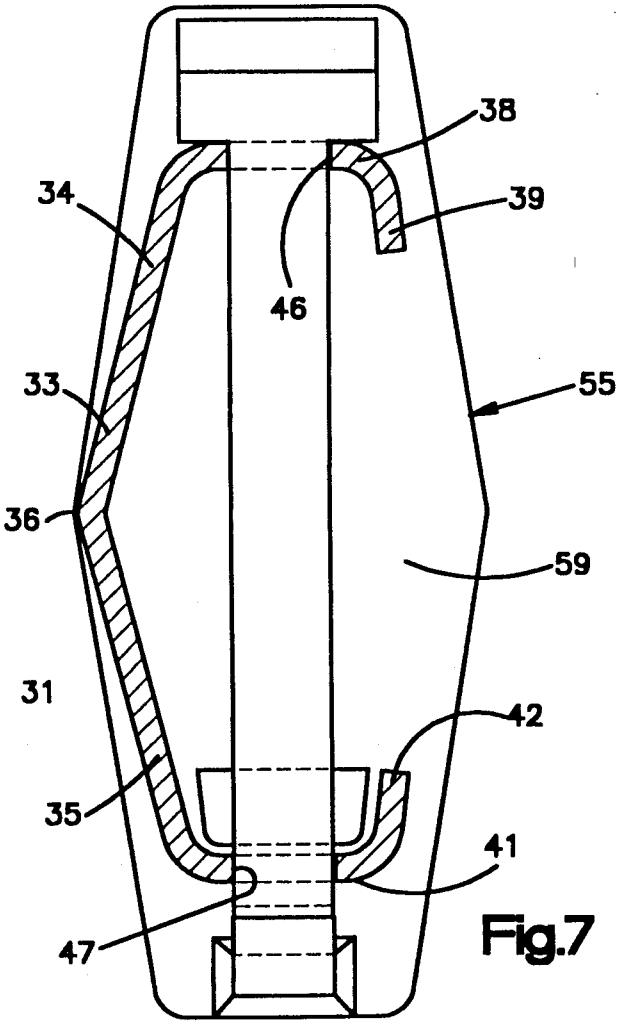
FIG. 7 is an enlarged, cross-sectional view, taken on line 7—7 of FIG. 6.

As shown in FIG. 8, each of the top and bottom front rolls 26 and 27 is provided with a reduced diameter central groove 29 which serves to guide and support a generally C-shaped channel or rail 31. Channel 31 is formed of a relatively thin sheet metal, such as stainless steel, and has a generally vertically extending side wall 33 which may be formed of upper and lower sloping portions 34 and 35 joined along a bend line 36, to provide additional stiffness and rigidity. Side wall 33 extends into a horizontal top wall 38 having an inturned flange 39 along the inner side. Likewise, a bottom wall 41 extends from the lower portion of side wall 33, and has an upwardly extending flange 42 along the lower surface. Thus, the entire channel 31 has a bilateral symmetry about the bend line 36. The channel is formed with an end face or edge 44 extending perpendicular to its longitudinal axis, and a spaced distance back from the end face 44. The top and bottom walls 38 and 41 are formed with rectangular openings 46 and 47, respectively, and similar openings are formed at the other end of the channel as well. As the channel 31 is suspended between the rollers 26 and 27 and oriented by the roller grooves 29, rack wheels 49 (preferably two in number) are mounted on the upper rack 25 to rotate about axles 51, which are affixed to suitable portions of the rack such as side wire 52.

Thus, it will be seen that as the upper rack 25 is moved horizontally in and out of the tub 12, as the rack wheels 49 roll within the channel 31, the channel 31, in turn, moves between the support rolls 26 and 27, so that the channel moves only part way out of the tub and provides full support for the rack, which may then be moved almost completely clear of the tub in its outermost position.

In order to prevent the rack wheels from escaping out of the ends of channel 31, as well as to retain the channel 31 in place between the support rollers 26 and 27, channel 31 is provided with an end cap 55 at each end. It will be understood that both ends of channel 31 are formed with openings 46 and 47, and the end cap 55 is designed so that it will fit at either end of the channel. The end cap 55 has a vertically extending main body portion 57 having an exposed outer end face 58 which may be finished in a decorative manner, if desired, such as being provided with a central, vertical ridge 56 from which the end face slopes toward both edges. In any case, it is desirable that the end face 58 be symmetrical about a vertical centerline to provide an identical appearance on both sides of the dishwasher tub.

Body 57 also has a flat inner face 59 which fits up against the channel end face 44. Top and bottom extensions 61 and 62 on the body 57 are extensions of the end faces 58 and 59, and extend upwardly and downwardly from the channel top and bottom walls 38 and 41, respectively. On the inner face of top extension 61 is a top projection 64 extending over the outer surface of channel top wall 38 and having a relatively thin hinge portion 66 adjacent the inner face 59. At the outer end of hinge portion 66 is an enlarged bumper portion 67 including a reverse hook portion 68 adapted to abut on the top surface of top wall 38, and having a width greater than opening 46 to positively position the end cap against downward movement with respect to the channel. An arm 69 of reduced width extends downward from the bumper portion 67 through opening 46, as well as opening 47, in the bottom wall 41, where it is provided with a tip portion 71. The tip portion 71 includes on the side away from body 57 a notch 72, while on the opposite side a hook portion 73 extends beneath the bottom surface of bottom wall 41, when the end cap is in the fully assembled position, to prevent upward movement of the end cap with respect to the channel.

A bottom projection 74 extends from the bottom extension 62 beneath the channel bottom wall 41, and has a relatively thin hinge portion 76 adjacent the inner face 59. At the outer end of hinge portion 76 is a hook portion 77 extending upward and into engagement with the notch 72 on arm 69 to provide a snap fit and detent to hold the end cap in position in the end of channel 31.

It should also be noted that the arm 69 is provided with a recess 79 at its mid-point within the channel 31, to form sloping sides 81, which generally have portions lying on a radius equal to that of the rack wheel 49, so that when the rack wheel 49 reaches the end of channel 31, the wheel engages the recess 79 and sloping sides 81 to provide a relatively large multipoint surface-abutting contact.

To further position the end cap 55, a bottom projection 83 extends from the inner face 59 above the bottom extension 62 to fit within the channel 31 just above the inner surface of bottom wall 41, and to have such a width that it prevents lateral movement of the lower end of the end cap with respect to the channel.

Figure 2:
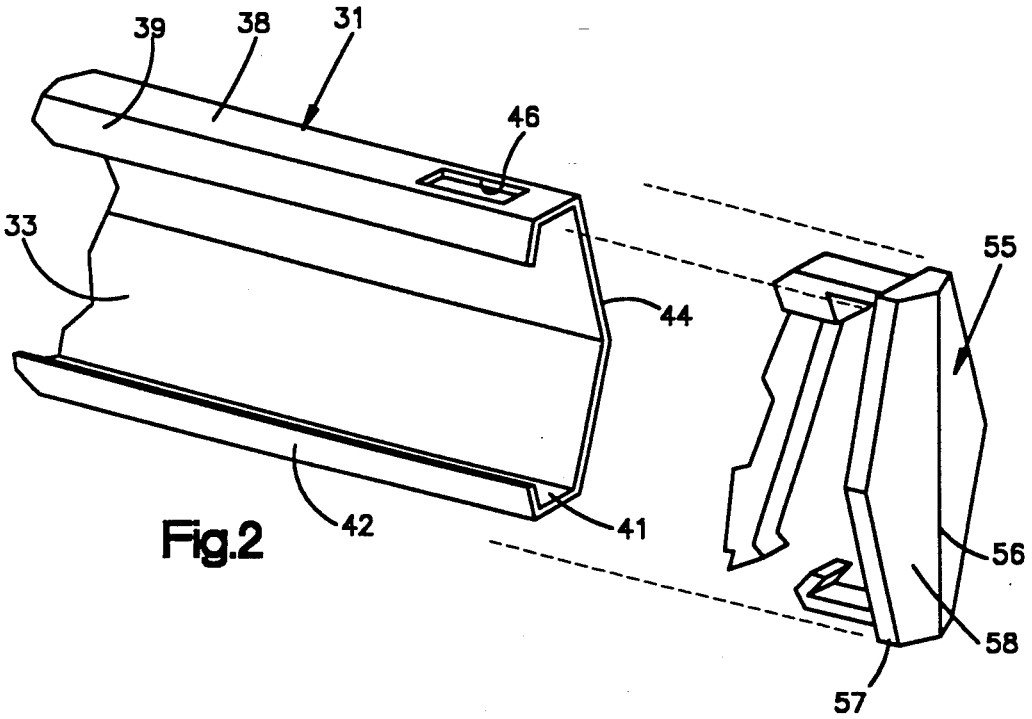
FIG. 2 is an exploded, perspective view of one end of the rack mounting channel or rail, with the end cap prior to assembly.
Figure 3:
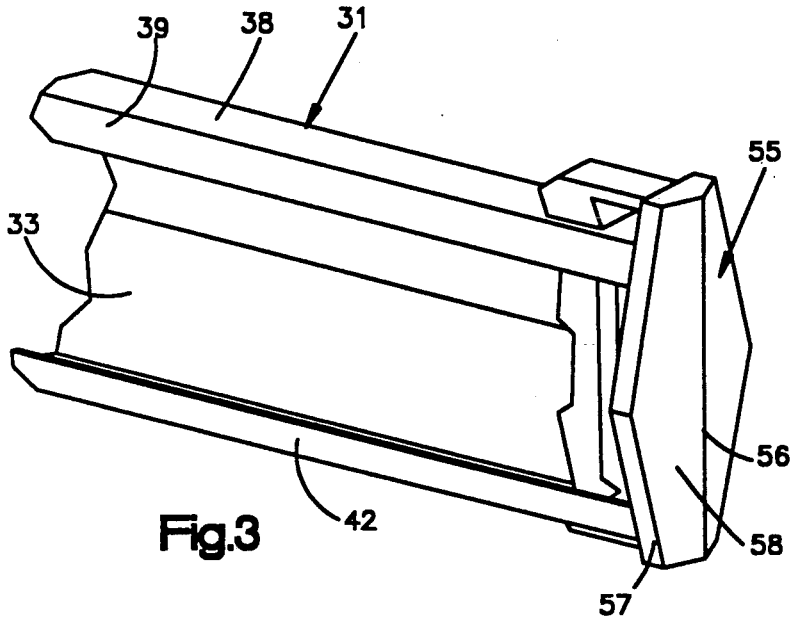
FIG. 3 is a view similar to FIG. 2, but with the end cap assembled in place.
Figure 4:
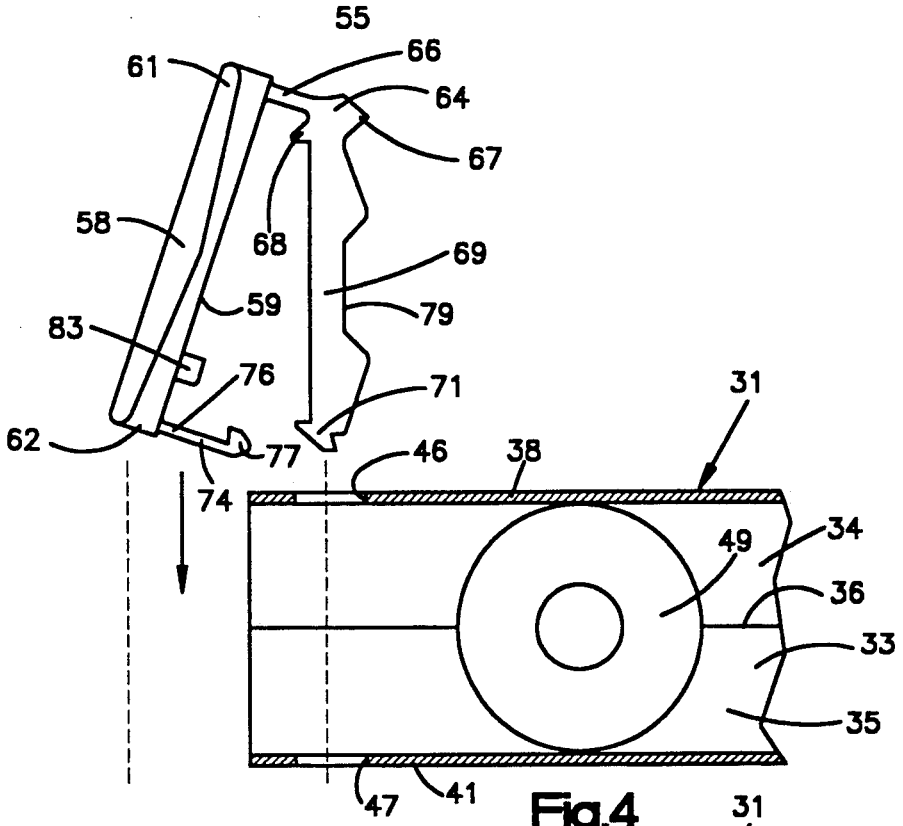
FIG. 4 is a vertical, cross-sectional view through the channel, showing the relative position of the rack wheel with the end cap exploded away prior to assembly.
Figure 5:
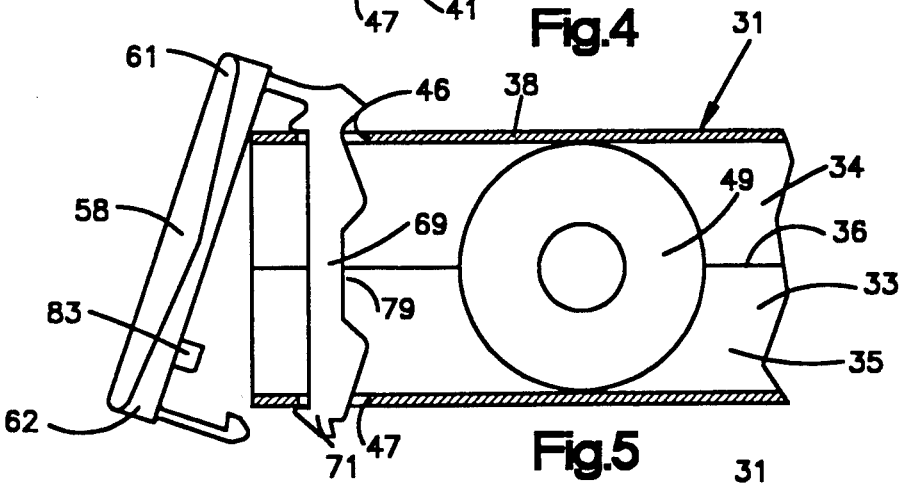
FIG. 5 is a view similar to FIG. 4, with the end cap inserted in position prior to final assembly.
Figure 6:
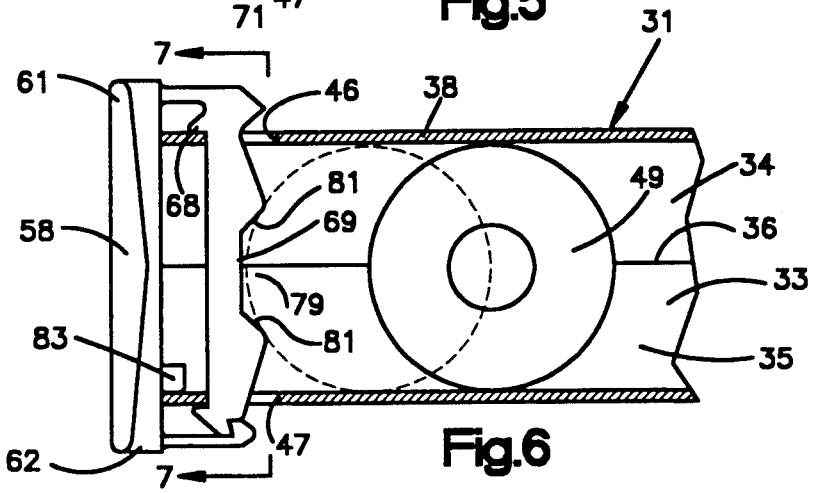
FIG. 6 is a view similar to FIG. 5 after the end cap has been fully assembled.

FIGS. 2-6 show how the end cap 55 is assembled on the end of channel 31. The end cap is in the open position, in which the arm 69 is bent along the hinge portion 66, to provide a gap between the tip 71 and hook portion 77 on bottom projection 74, as shown in FIGS. 2 and 4. The arm 69 is then inserted, preferably from the top, through the openings 46 and 47 until the reverse hook 68 contacts the tap surface of the channel top wall 38, while the hook 73 on tip 71 extends beneath the bottom surface of channel bottom wall 41, as shown in FIG. 5. The body 57 is then moved inwardly so that the projection 83 fits within the bottom portion of channel 31, while the hook portion 77 snaps over tip 71 to engage the notch 72. When this assembly is complete, the end cap 55 is immovably positioned on the end of channel 31. Downward movement with respect to the channel is prevented by engagement of the bumper portion 67 with both the top surface of top wall 38 and the projection 83 against the inside of the bottom wall 41. Likewise, the hook 73, by engaging the undersurface of bottom wall 41, prevents upward movement of the body 57. Engagement of the arm 69 against the sides of openings 46 and 47 prevents lateral movement of the arm and of the body 57 at the top, because of the connection through hinge portion 66, and the projection 83 at the bottom, by its engagement with the lower channel wall portion 35 and flange 42, prevents lateral movement of the bottom portion of body 57.

Furthermore, since the bumper portion 67 extends above the top wall 38 of channel 31, and since the arm tip 71 and bottom projection 74 extend below the bottom surface of bottom wall 41, these members engage the grooves 29 on the support rollers 26 and 27, and by having end caps 55 at both ends of the channels, the inward movement of the channel with respect to the tub is prevented by having the front end cap contact the rollers 26 and 27. When the rack 25 is pulled all the way out, the rack wheels 49 can roll until they reach the front bumper, after which the channel 31 must move out along the support rollers until the rear bumper (not shown) engages the other set of support rollers adjacent the mid-portion of the tub, so that thereby outward movement of the channel and the rack is limited in a position where the rack is still solidly supported by the tub.

On the other hand, if it is desired to remove the upper rack 25, it is only necessary to remove the front end cap by deflecting the hook portion 77 by bending along the hinge portion 76 and then moving the body 57 to an outward position as shown in FIG. 5. Then, the end cap 55 is simply removed by pulling the arm 69 upward through openings 46 and 47. With the front end cap removed, the rack may be removed from the channel, since the rack wheels 49 can now pass beyond the end of the channel. If it is also desired to remove the channel 31, it is then necessary to reach inside the dishwasher to remove the end cap at the back of the channel so that the channel can now pass outwardly through the support rollers. The upper rack can easily be reassembled by reversing the above motions and reassembling the end caps as previously described.

Although the preferred embodiment of this invention has been shown and described in detail, it is recognized that various modifications and rearrangements of the parts may be resorted to without departing from the scope of the invention as disclosed and claimed herein.

What is claimed is:

1. In a dishwasher having a slidable rack carried on support means on the side walls of the dishwasher tub, said support means including C-shaped channels on each of the side walls and rollers journaled on said rack fitting within each of said channels and a cap at one open channel end, the improvement in said cap being a unitary end closure for releasably engaging the end of said channel, said channel having upper and lower opposed wall portions with aligned openings spaced from said open end, said end closure including a body portion engageable with said open end and an arm portion extending through said aligned openings, said arm portion being joined to said body portion by a hinge portion adjacent one of said wall portions, said arm portion and said body portion having interengaging detent means adjacent the other of said wall portions.

2. A dishwasher according to claim 1, wherein said body portion extends beyond said channels at both of said wall portions.

3. A dishwasher as set forth in claim 2, wherein said hinge portion is on the outer side of said one wall portion.

4. A dishwasher as set forth in claim 3, wherein said arm portion adjacent said hinge portion includes a portion abutting said outer side adjacent the opening.

5. A dishwasher as set forth in claim 2, wherein said detent means are on the outer side of the other of said wall portions.

6. A dishwasher as set forth in claim 5, wherein said arm portion has a hook portion engaging said outer side of said other wall portion adjacent the opening.

7. A dishwasher as set forth in claim 6, wherein said body portion includes a projection extending adjacent the inner side of said other wall portion.

8. A dishwasher having a tub and a slidable rack mounted in said tub, support means for said rack on the side walls of said tub, said support means including vertically spaced support rollers on the side walls of said tub, a C-shaped channel on each of the side walls slidably carried by said support rollers for horizontal movement along said tub side wall, rack wheels journaled on said rack and fitting within each of said channels to support said rack for horizontal movement along said channel, and an end cap secured to said channel at each open channel end, each of said caps being a unitary member operable to prevent said rack wheels from moving out of said channel and limiting said channel from moving out of engagement with said support rollers, said channel having upper and lower opposed wall portions with aligned openings spaced from said open end, said end cap including a body portion abutting said open end and an integral arm portion extending parallel to said body portion through said aligned openings, said arm portion being joined to said body portion by a hinge portion adjacent one of said wall portions, said arm portion and said body portion having interengaging detent means adjacent the other of said wall portions.

9. A dishwasher as set forth in claim 8, wherein said body portion extends beyond said channel at both of said wall portions to permit engagement between said body portion and an adjacent support roller to limit movement of said channel with respect to said tub.

10. A dishwasher as set forth in claim 9, wherein said hinge portion extends along the outer side of said one wall portion.

11. A dishwasher as set forth in claim 10, wherein said arm portion adjacent said hinge portion has a portion wider than the remainder of said arm portion and wider than the adjacent opening to abut against said outer side adjacent said opening.

12. A dishwasher as set forth in claim 9, wherein said detent means are on the other side of the other of said wall portions.

13. A dishwasher as set forth in claim 12, wherein said detent means comprises a flexible hook extending from said body portion and a notch on said arm.

14. A dishwasher as set forth in claim 12, wherein said arm portion has a hook portion extending toward said body portion and engaging said outer side of said other wall portion adjacent the opening.

15. A dishwasher as set forth in claim 14, wherein said body portion includes a projection extending into said channel adjacent the inner side of said other wall portion to limit lateral movement of said body portion with respect to said channel.

16. A dishwasher as set forth in claim 8, wherein said arm has sloping surfaces facing the adjacent rack wheel, whereby said rack wheel engages said arm with multipoint contact around the periphery of said rack wheel.

* * * * *